US009853367B2

(12) United States Patent
Kihara et al.

(10) Patent No.: US 9,853,367 B2
(45) Date of Patent: Dec. 26, 2017

(54) WIRE HARNESS, METHOD OF CONNECTING TERMINAL AND COATED WIRE, AND MOLD

(71) Applicants: FURUKAWA ELECTRIC CO., LTD., Tokyo (JP); FURUKAWA AUTOMOTIVE SYSTEMS INC., Inukami-gun (JP); TOYOTA JIDOSHA KABUSHIKI KAISHA, Toyota-shi (JP)

(72) Inventors: Yasushi Kihara, Tokyo (JP); Yukihiro Kawamura, Inukami-gun (JP); Takashi Tonoike, Inukami-gun (JP); Takahito Nakashima, Okazaki (JP); Hiroshi Kobayashi, Okazaki (JP); Hiroyasu Taga, Toyota (JP)

(73) Assignees: FURUKAWA ELECTRIC CO., LTD., Tokyo (JP); FURUKAWA AUTOMOTIVE SYSTEMS INC., Inukami-gun (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/033,462

(22) PCT Filed: Nov. 4, 2014

(86) PCT No.: PCT/JP2014/079187

§ 371 (c)(1),
(2) Date: Apr. 29, 2016

(87) PCT Pub. No.: WO2015/064763

PCT Pub. Date: May 7, 2015

(65) Prior Publication Data

US 2016/0276754 A1 Sep. 22, 2016

(30) Foreign Application Priority Data

Nov. 1, 2013 (JP) ..... 2013-228270

(51) Int. Cl.
*H01R 4/18* (2006.01)
*H01R 4/20* (2006.01)
(Continued)

(52) U.S. Cl.
CPC ..... *H01R 4/185* (2013.01); *H01R 4/20* (2013.01); *H01R 13/5205* (2013.01); *H01R 43/058* (2013.01)

(58) Field of Classification Search
CPC ..... H01R 43/048; H01R 4/18; H01R 4/183; H01R 4/20
See application file for complete search history.

(56) References Cited

U.S. PATENT DOCUMENTS 3,212,050 A 10/1965 Stark
3,955,044 A * 5/1976 Hoffman ..... H01R 4/62 174/84 C (Continued)

FOREIGN PATENT DOCUMENTS

CN 1914770 A 2/2007
CN 101645542 A 2/2010

(Continued)

OTHER PUBLICATIONS

Japanese Office Action dated Aug. 30, 2016 in Patent Application No. 2015-545336 (with English translation).

(Continued)

*Primary Examiner* — James Harvey
*Assistant Examiner* — Oscar C Jimenez
(74) *Attorney, Agent, or Firm* — Oblon, McClelland, Maier & Neustadt, L.L.P.

(57) ABSTRACT

The height (F) of a protruding portion (7) is less than the thickness of a crimping portion (5) before crimping. If the height of the protruding portion (7) is greater than the thickness of the crimping portion, then a recess is prone to form in the inner surface of the crimping portion (5). In other words, because there is more metal flowing outwards, a recess corresponding to the metal flow is prone to form on the inner surface side. If such a recess does form, adhesion with a covered area (27) is likely to deteriorate. This is problematic because such a gap would be a path allowing the ingress of moisture. On the other hand, if the height of the protruding portion (7) is less than the thickness of the crimping portion (5) before crimping, then when the crimping portion (5) is compressed during crimping, the amount of metal flowing towards the protruding portion (7) diminishes, making it possible to suppress the formation of a receding portion on the inner surface of the crimping portion (5).

4 Claims, 10 Drawing Sheets

(51) Int. Cl.
*H01R 13/52* (2006.01)
*H01R 43/058* (2006.01)

(56) References Cited

U.S. PATENT DOCUMENTS

| | | | | |
|---|---|---|---|---|
| 5,414,926 | A * | 5/1995 | Ito | H01R 43/048 29/753 |
| 6,468,116 | B2 * | 10/2002 | Koide | H01R 4/184 439/867 |
| 2001/0002508 | A1 * | 6/2001 | Yamakawa | H01R 43/058 29/753 |
| 2004/0168315 | A1 | 9/2004 | Onuma | |
| 2007/0054568 | A1 | 3/2007 | Roset | |
| 2007/0128955 | A1 * | 6/2007 | Nishio | G01N 27/4071 439/877 |
| 2009/0191771 | A1 | 7/2009 | Watanabe | |
| 2012/0006596 | A1 * | 1/2012 | Kuwayama | H01R 4/188 174/84 C |
| 2012/0214361 | A1 | 8/2012 | Endo | |
| 2012/0285715 | A1 * | 11/2012 | Mayer | H01R 9/032 174/34 |
| 2013/0029523 | A1 | 1/2013 | Poma et al. | |
| 2013/0035007 | A1 | 2/2013 | Onuma | |
| 2014/0073205 | A1 * | 3/2014 | Gery | H01R 4/203 439/877 |
| 2015/0072573 | A1 * | 3/2015 | Kawamura | H01R 4/203 439/867 |
| 2015/0364833 | A1 * | 12/2015 | Tonoike | H01R 4/183 439/879 |
| 2016/0240938 | A1 * | 8/2016 | Kawamura | H01R 43/048 |

FOREIGN PATENT DOCUMENTS

| | | | | |
|---|---|---|---|---|
| CN | 102904079 | A | 1/2013 | |
| CN | 103004038 | | 3/2013 | |
| CN | 104126252 | A | 10/2014 | |
| JP | 55-37069 | B1 | 9/1980 | |
| JP | 2002-216862 | A | 8/2002 | |
| JP | 2002-367714 | A | 12/2002 | |
| JP | 2004-71437 | A | 3/2004 | |
| JP | 2004-111058 | A | 4/2004 | |
| JP | 2004-200094 | A | 7/2004 | |
| JP | 2006-331931 | A | 12/2006 | |
| JP | 2009-135022 | A | 6/2009 | |
| JP | 2009-176571 | A | 8/2009 | |
| JP | 2009-218072 | A | 9/2009 | |
| JP | 2009-295333 | A | 12/2009 | |
| JP | 2010-244882 | A | 10/2010 | |
| JP | 2011-70840 | A | 4/2011 | |
| JP | 2011-96451 | A | 5/2011 | |
| JP | 2011-222243 | A | 11/2011 | |
| JP | 2011-222394 | A | 11/2011 | |
| JP | 2011-243467 | A | 12/2011 | |
| JP | 2012-48833 | A | 3/2012 | |
| JP | 2013-33722 | A | 2/2013 | |
| JP | WO 2014129084 | A1 * | 8/2014 | H01R 4/203 |
| JP | 2014-187045 | A | 10/2014 | |
| JP | 5625136 | B1 | 11/2014 | |
| KR | 10-2015-0120846 | A | 10/2015 | |
| WO | WO 2009/147754 | A1 | 12/2009 | |
| WO | WO 2014/129220 | A1 | 8/2014 | |

OTHER PUBLICATIONS

Japanese Office Action dated Jun. 7, 2016 in Patent Application No. 2015-545336 (with English translation).
International Search Report dated Jan. 13, 2015 in PCT/JP2014/079187 (with English language translation).
International Search Report dated Apr. 15, 2014 in PCT/JP2014/050167 (English language translation only).
Office Action dated Apr. 14, 2014 in Japanese Patent Application No. 2014-508409 (with English language translation).
Office Action dated Jun. 30, 2014 in Japanese Patent Application No. 2014-508409 (with English language translation).
Office Action dated Aug. 4, 2014 in Japanese Patent Application No. 2014-118751 (with English language translation).
Office Action dated Sep. 22, 2014 in Japanese Patent Application No. 2014-508409.
Office Action dated Oct. 27, 2014 in Japanese Patent Application No. 2014-118751.
Office Action dated Dec. 19, 2016 in Korean Patent Application No. 10-2016-7006191 (with English translation).
Chinese Office Action dated Apr. 19, 2017, for Application No 201480053933.5 (with English translation).
Chinese Office Action (with English Translation) for related Chinese Application No. 201480000692.8, dated Jan. 25, 2017, 22 pages.
Chinese Office Action dated Sep. 25, 2017 in related Chinese Application No. 201480000692.8, (with English Translation), 23 pages.

* cited by examiner (a)

(b)

WIRE HARNESS, METHOD OF CONNECTING TERMINAL AND COATED WIRE, AND MOLD

TECHNICAL FIELD OF THE INVENTION

This invention relates to wire harness and the like that is used for motor vehicles and the like.

BACKGROUND OF THE INVENTION

Conventionally, crimp bonding, in which an electric wire is caulked and crimped by a terminal called open-barrel type, is common for connecting an electric wire and a terminal in a wire harness for motor vehicles. However, in such a wire harness, if moisture or the like attaches the connection part of the electric wire and the terminal, oxidization of metal surface that is used for the electric wire progresses, increasing the resistance at the joint part. Also, if different metals are used for the electric wire and the terminal, corrosion between different metals may progress. The progress of corrosion of metal materials at the connection part causes cracks or contact failure at the connection part and its effect on product life is unavoidable. Particularly in recent years, a wire harness having electrical wires made of aluminum alloy and terminals made of copper alloy has been in practical use, and the problem of corrosion at the joint part thereof has become noteworthy.

Here, if moisture attaches to the contacting part of different metals such as aluminum and copper for example, so-called electrolytic corrosion may occur due to difference in corrosion potential. Particularly, since the potential difference between aluminum and copper is large, corrosion on the side of aluminum, which is an electrically base metal, progresses. Therefore, the connection state between the conducting wires and crimp terminals becomes unstable, causing an increase in contact resistance or an enlargement of electrical resistance due to decrease in wire diameters, and, furthermore, disconnection of the wires may occur which may result in malfunction or breakdown of the electrical components.

Disclosed is such a wire harness in which different metals are in contact and resin material is filled to cover the connection part of electrical wires and crimp terminals (Patent Document 1). Filing the resin material prevents moisture from attaching to the contact part of electrical wires and crimp terminals.

Also, a method using a terminal having a cylindrical crimping portion of which one end is closed has been proposed (Patent Document 2). An end part of a coated wire is inserted into the cylindrical crimping portion, and then the cylindrical crimping portion is crimped by caulking to make the covered portion and the crimping portion adhered to each other so that moisture such as rain water or sea water can be prevented from entering into the inner core wire part of the crimping portion.

RELATED ART

Patent Documents

[Patent Document 1] Japanese Unexamined Patent Application Publication No. 2004-111058 (JP-A-2004-111058)
[Patent Document 2] Japanese Unexamined Patent Application Publication No. 2006-331931 (JP-A-2006-331931)

SUMMARY OF THE INVENTION

Problems to be Solved by the Invention

However, in the method of Patent Document 1, since the resin material has to be filled separately, there is a problem that the manufacturing process becomes complicated and the management in the manufacturing process also becomes complicated to that extent. Also, the cost of the whole wire harness is raised due to the complication of the process.

Meanwhile, a pair of crimping metal molds is used in Patent Document 2 to crimp a cylindrical crimping portion. For example, there is a method in which the crimping portion is crimped by fitting an anvil mold of which an inner face is arc shaped into a crimper mold so that the cross-section of the crimping portion has an approximately circular shape. On this occasion, the tip part of the anvil mold requires a certain thickness in need of securing rigidity. Therefore, if the crimping portion is crimped by such metal molds, a protruding thickness-flowing part according to the thickness of the tip part of the anvil mold is formed on the periphery surface of the crimping portion at the fitting section of the molds.

When an excessively large protruding portion is generated on the periphery surface of the crimping portion, the metal flows toward outside at the time of crimping and, therefore, a recess may be generated on the inner surface of the crimping portion. If such a recess is generated on the inner surface of the crimping portion, the resin of the covered portion is pushed into the recess so that the pressure distribution of the covered portion becomes non-uniform. Therefore, with influence of stress relaxation at a high temperature and the like for example, it becomes difficult to secure the adhesion between the recess and the covered portion. As a result, it may be impossible to secure sufficient water cut-off performance at the crimping portion.

The present invention was achieved in view of such problems. Its object is to provide a wire harness in which water cut-off performance can be secured for a terminal having a cylindrical crimping portion, a method of connecting the terminal and a coated wire, and a mold.

Means for Solving Problems

To achieve the above object, a first invention is a wire harness in which a coated wire and a terminal are connected. The terminal includes an approximately cylindrical crimping portion, in which the coated wire is crimped, and a terminal body. Except for a part through which the coated wire is inserted, other parts of the crimping portion are sealed. A protruding portion is formed along a longitudinal direction of the terminal on a periphery surface of the crimping portion that corresponds to a covered portion of the coated wire. The protruding height of the protruding portion from a periphery surface of the crimping portion in a direction perpendicular to a compression direction of the crimping portion on a cross section in a diameter direction of the crimping portion is equal to or less than a body thickness of the crimping portion before crimping.

The protruding portion may be formed at a position that corresponds to a fitting section of a first mold and a second mold that are used for crimping.

A level difference may be formed between the protruding portion and the periphery surface of the crimping portion on the cross section in the diameter direction of the crimping portion, and a tilted portion that is tilted toward the direction perpendicular to the compression direction of the crimping portion may be provided on the level difference.

According to the first invention, since the height of the protruding portion formed along the longitudinal direction of the terminal is less than the thickness of the crimping portion before crimping, it is possible to suppress the formation of a recess portion on the inner surface of the crimping portion when the coated wire is inserted into the approximately cylindrical crimping portion and the crimping portion is crimped by a pair of molds. Therefore, the inner surface of the crimping portion and the covered portion adhere to each other and high water cut-off performance can be secured.

Also, on the cross section, forming the tilted portion on the level difference between the protruding portion and an arc portion of the periphery surface of the crimping portion can diminish a rapid changing portion in the flowing direction of the metal so that it is possible to prevent the formation of the recess portion on the inner surface of the crimping portion with more certainty.

A second invention is a method of connecting a terminal and a coated wire. The terminal includes a crimping portion, in which the coated wire is crimped, and a terminal body. Except for a part through which the coated wire is inserted, other parts of the crimping portion are sealed and the coated wire is inserted into the crimping portion. To press the crimping portion, a first mold and a second mold that face each other are used. The first mold is fitted into an inner part of the second mold to crimp a covered portion of the coated wire at the crimping portion. This forms a protruding portion on the periphery surface of the crimping portion at a position corresponding to a fitting section of the first mold and the second mold. The protruding height of the protruding portion from a periphery surface of the crimping portion in a direction perpendicular to a compression direction of the crimping portion on a cross section in a diameter direction of the crimping portion is equal to or less than a body thickness of the crimping portion before crimping.

At an end portion of the first mold, a tapered portion that is tilted inward to a direction perpendicular to the compression direction of the first mold and the second mold may be provided. On the cross section in the diameter direction of the crimping portion, a level difference corresponding to the shape of the end portion of the first mold may be formed on the protruding portion between the protruding portion and the periphery surface of the crimping portion and a tilted portion corresponding to the tapered portion may be provided on the level difference.

According to the second invention, making the thickness of a tip of one of the molds (the anvil mold) thinner than the thickness of the terminal before crimping can make the height of the protruding portion less than the thickness of the terminal. As a result, it is possible to suppress the formation of a recess portion on the inner surface of the crimping portion.

Also, by forming the tilted portion at the tip portion of one of the mold (the anvil mold), a tilted portion can be formed at the level difference between the protruding portion and an arc portion of the periphery surface of the crimping portion. Therefore, a rapid changing portion in a flow direction of the metal is diminished and it is possible to prevent the formation of the recess portion on the inner surface of the crimping portion with certainty.

A third invention is a mold that is used for crimping a terminal and a coated wire and comprises a first mold and a second mold that face each other. The first mold fits into an inner portion of the second mold so that it is possible to crimp a covered portion of the coated wire with the terminal. At an end portion of the first mold, a tapered portion that is tilted inward to a direction perpendicular to the compression direction of the first mold and the second mold is provided. A level difference according to a shape of the end part, of the first mold is formed on a periphery surface of the terminal after crimping and a tilted portion corresponding to the tapered portion can be formed at the level difference.

According to the third invention, by forming the tilted portion at the tip portion of one of the mold (the anvil mold), a tilted portion can be formed at the level difference between the protruding portion and an arc portion of the periphery surface of the crimping portion. Therefore, a rapid changing portion in a flow direction of the metal is diminished and it is possible to prevent the formation of the recess portion on the inner surface of the crimping portion with certainty.

Effects of the Invention

The present invention can provide a wire harness in which water cut-off performance can be secured for a terminal having a cylindrical crimping portion, a method of connecting the terminal and a coated wire, and a mold.

BRIEF DESCRIPTION OF DRAWINGS

FIG. 8 (*b*) is an enlargement view of the proximity of a tip portion of the mold 31*b*.

FIG. 8 (*c*) is an enlargement view of the proximity of a tip portion of the mold 31*b*.

FIG. 9 (*b*) is an enlargement view of the protruding portion 7 formed on the crimping portion 5 by the mold shown in FIG. 8 (*c*).

DESCRIPTION OF SOME EMBODIMENTS

Figure 1:
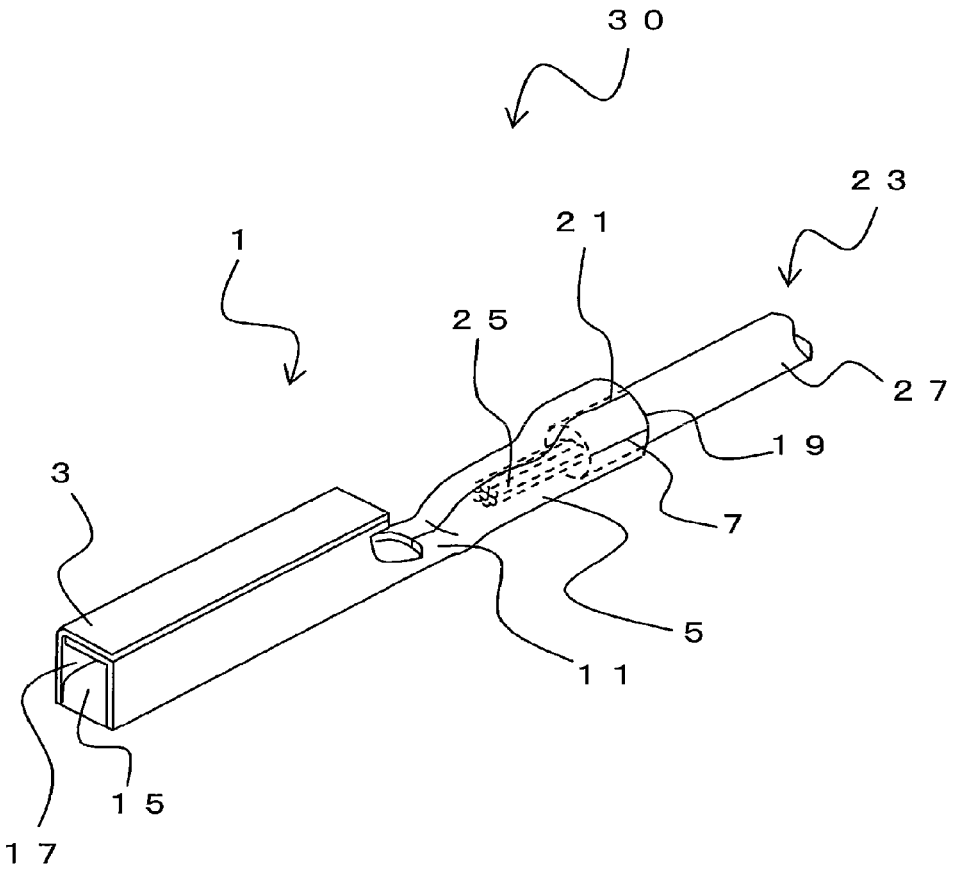
FIG. 1 is a perspective view showing a wire harness 30.

Hereinafter, embodiments of the present invention will be described in detail with reference to the accompanying drawings. FIG. 1 shows a wire harness 30. The wire harness 30 is formed by connecting a terminal 1 and a coated wire 23.

The terminal 1 includes a terminal body 3 and a crimping portion 5 that are formed integrally. A male-type connector, which is not shown in the drawing, can be inserted into the terminal body 3 from a front-end portion 17 of its longitudinal direction. The terminal body 3 is equipped with an elastic contacting piece 15 that contacts with an insertion tab of the male-type connector.

The crimping portion 5 is a closed type and formed in an approximately cylindrical shape. The crimping portion 5 is formed by rolling up a plate-like material into an approximately cylindrical shape and joining edges thereof each other at a joining part 21. Also, a sealed portion 11 is provided at the front-end portion of the crimping portion 5 (on the side of the terminal body 3). That is, the crimping portion 5 is sealed except for a rear-end portion 19 through which the coated wire 23 is inserted. The joint portion 21 and the sealed portion 11 are welded by laser welding and the like for example.

The terminal 1 is formed by pressing using a plate-like member made of copper, for example. That is, every part of the terminal 1 before sealing and crimping has an approximately equal thickness. However, the thickness of the sealing portion 11 or the crimping portion 5 of the terminal 1 changes during sealing or crimping. Therefore, for example, in order to get the thickness of the terminal 1 before crimping from the wire harness 30, the thickness of one sheet of the material used for the terminal body 3 is to be measured.

In the coated wire 23, an insulating covered area 27 coats wires 25. When the coated wire 23 is inserted into the crimping portion 5, a part of the covered area 27 at the tip of the coated wire 23 is removed to expose the wires 25. For the covered area 27, a material that is usually used in this technical field such as polyvinyl chloride (PVC), polyethylene, or the like can be chosen. Also, for the wires 25, aluminum or aluminum alloy can be applied, for example.

On the periphery surface of the crimping portion 5, a protruding portion 7 is formed along a longitudinal direction thereof. The protruding portion 7 is formed during crimping the crimping portion 5. The protruding portion 7 will be described in detail later.

Since the crimping portion 5 is crimped with the wires 25 and the covered area 27, the crimping portion 5 adheres with the covered area 27 so to seal the crimping portion 5. On this occasion, all parts of the crimping portion 5 except for the rear-end portion 19 are sealed to be watertight by the joint portion 21 and the sealing portion 11 so that moisture entering into the crimping portion 5 can be prevented.

Figure 2:
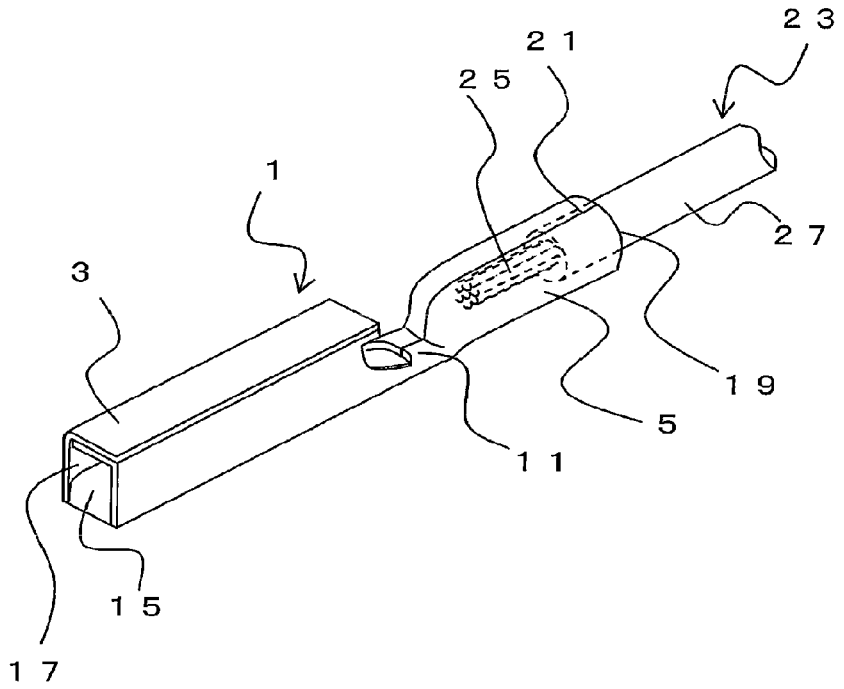
FIG. 2 is a perspective view showing a state in which a coated wire 23 is inserted into a terminal 1.
Figure 3:
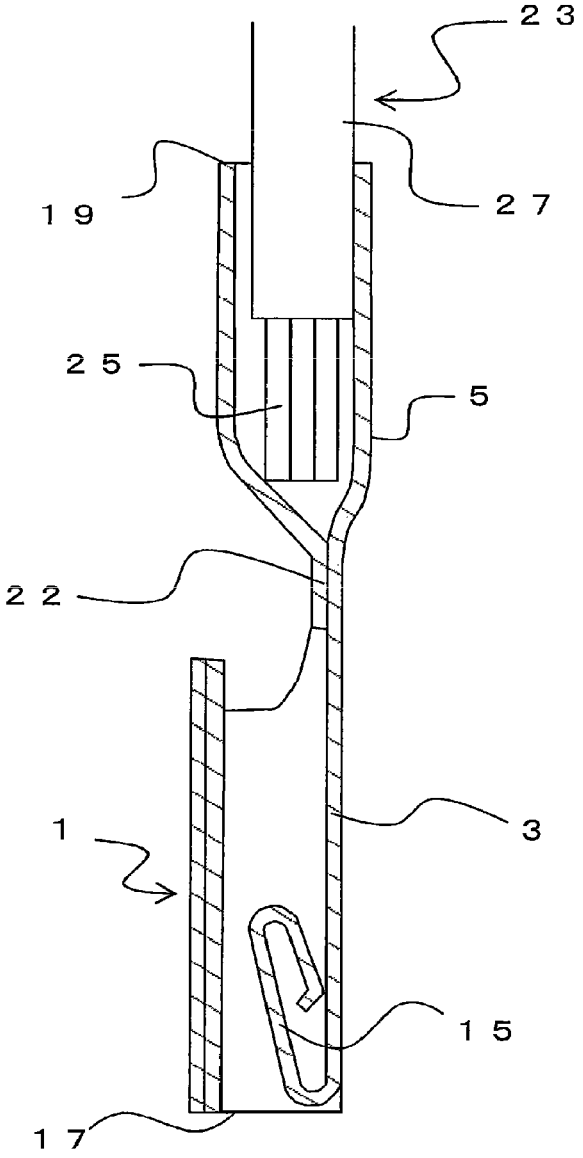
FIG. 3 is a longitudinal section of FIG. 2.

Next, a forming process of a wire harness will be described. FIG. 2 and FIG. 3 show a connecting process of the terminal 1 and the coated wire 23 where FIG. 2 is a perspective view and FIG. 3 is a longitudinal section. First, the coated wire 23 is inserted into the cylindrical crimping portion 5. As mentioned above, the covered area 27 at the tip part of the coated wire 23 is removed to expose the wires 25. Both the exposed part of the wires 25 and the covered portion of the covered area 27 are positioned inside the crimping portion 5.

Figure 4:
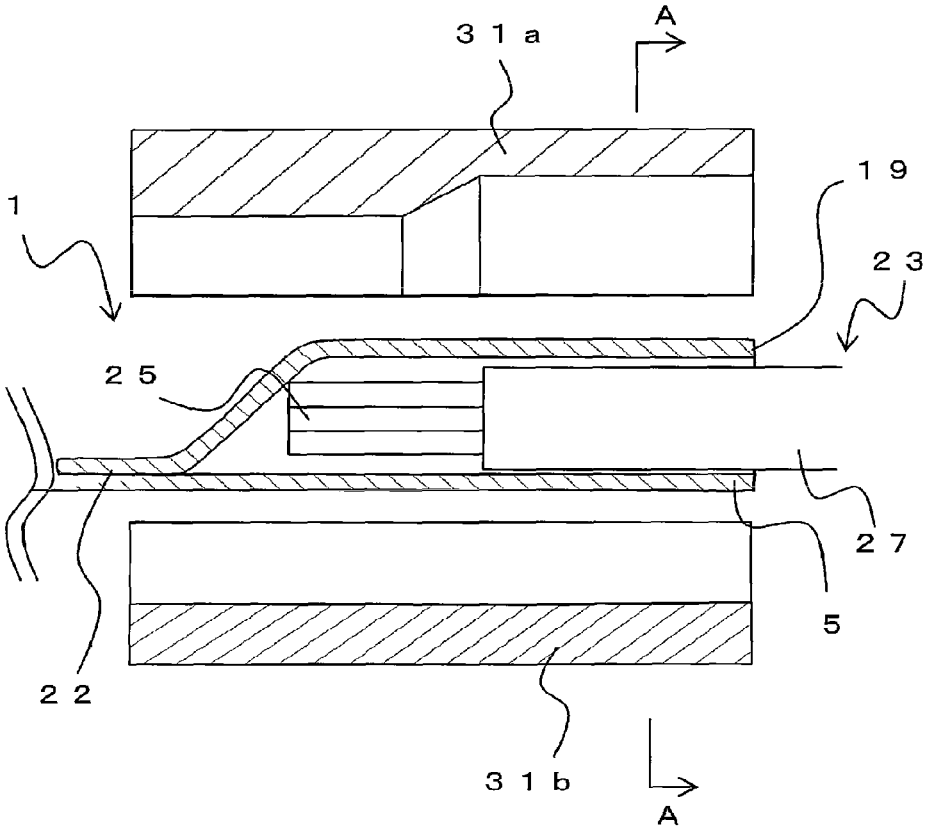
FIG. 4 is a cross section showing a state in which a crimping portion 5 is arranged between a mold 31*a* and a mold 31*b*.

Next, the crimping portion 5 is compressed by the mold. FIG. 4 is a longitudinal partial section showing the state in which the crimping portion 5 is arranged between a mold 31*a* and a mold 31*b*. As shown in FIG. 4, the crimping portion 5 is arranged between a pair of molds 31*a* and 31*b*.

Figure 5:
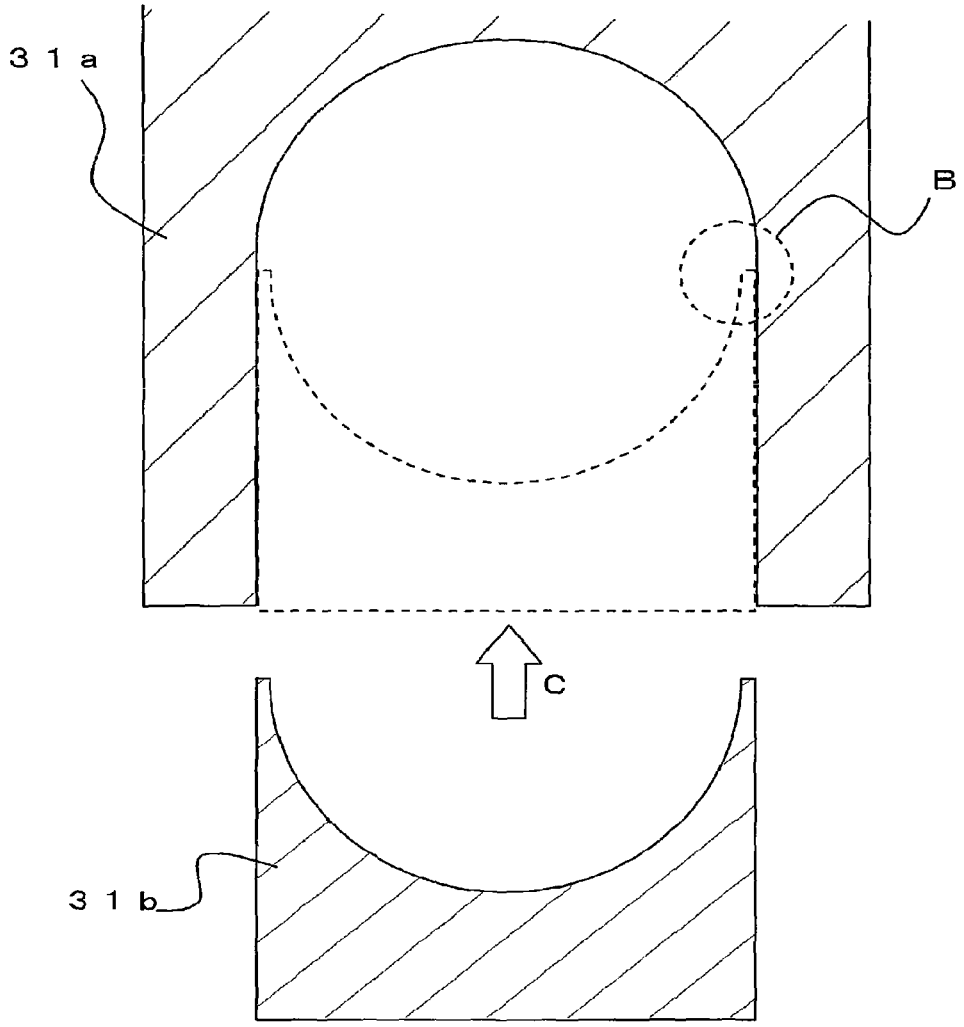
FIG. 5 is a cross section of the molds 31*a* and 31*b* of A-A line in FIG. 4.

FIG. 5 is a cross section of the molds 31*a* and 31*b* on a cross section of A-A line in FIG. 4. That is, FIG. 5 shows the shapes of the molds 31*a* and 31*b* at the part in which the covered area 27 is crimped. The mold 31*b*, which is the first mold, is an anvil mold and the mold 31*a*, which is the second mold, is a crimper mold. The molds 31*a* and 31*b* are arranged to face each other and at least one of the molds can move toward the direction so to approach each other (the direction shown by an arrow C in the drawing). The facing surfaces of the molds 31*a* and 31*b* are formed in arc shapes. The mold 31*b* is fitted into the mold 31*a* to form an approximately circular shape.

Figure 6:
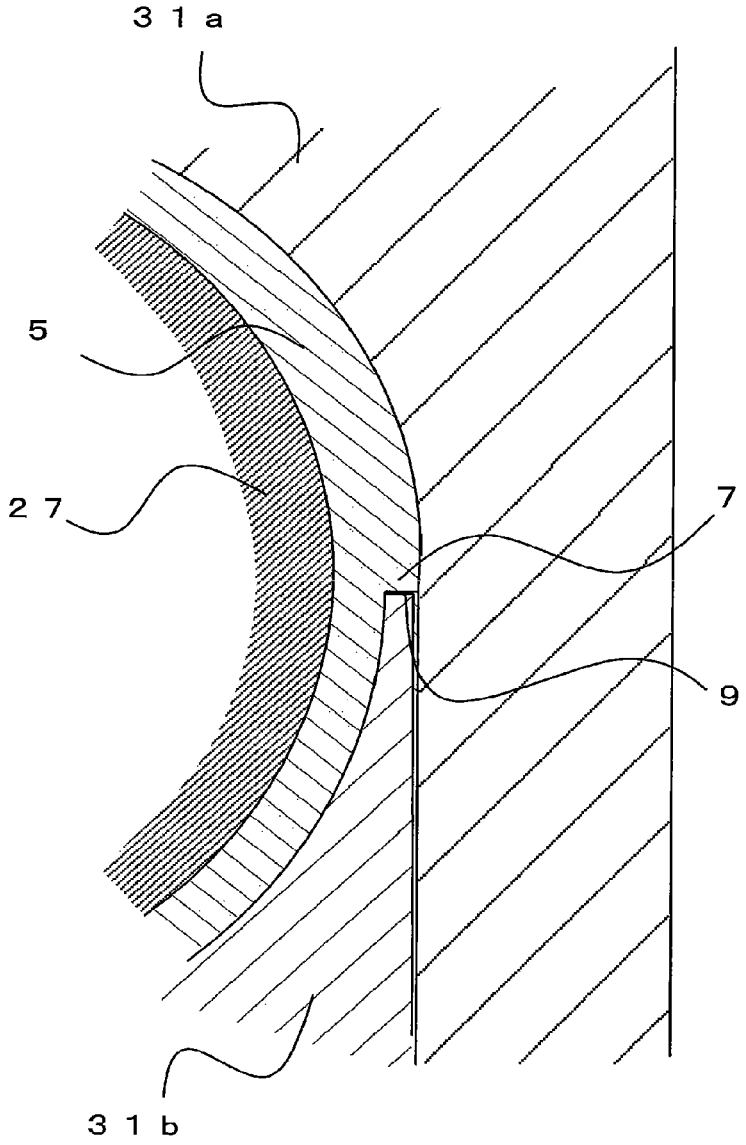
FIG. 6 is an enlarged view of the proximity of a fitting section when a crimping portion 5 is crimped by the molds 31*a* and 31*b*.

FIG. 6 is an enlarged view of the proximity of B part in FIG. 5 when the crimping portion 5 is crimped. Since certain rigidity is required for the tip portion of the mold 31*b* (the proximity of the border with the inner circumference face of the mold 31*a*), the tip portion of the mold 31*b* cannot be sharpened completely and a measurable thickness is required. For this reason, when the molds 31*a* and 31*b* crimp the crimping portion 5 (and the coated wire 23), the protruding portion 7 corresponding to the thickness of the tip portion of the mold 31*b* is formed at the fitting section of the molds 31*a* and 31*b*. Since the protruding portion 7 is formed along the fitting section of the molds 31*a* and 31*b*, the protruding portion 7 is formed in a straight line along a longitudinal direction of the crimping portion 5 (two places).

Figure 7:
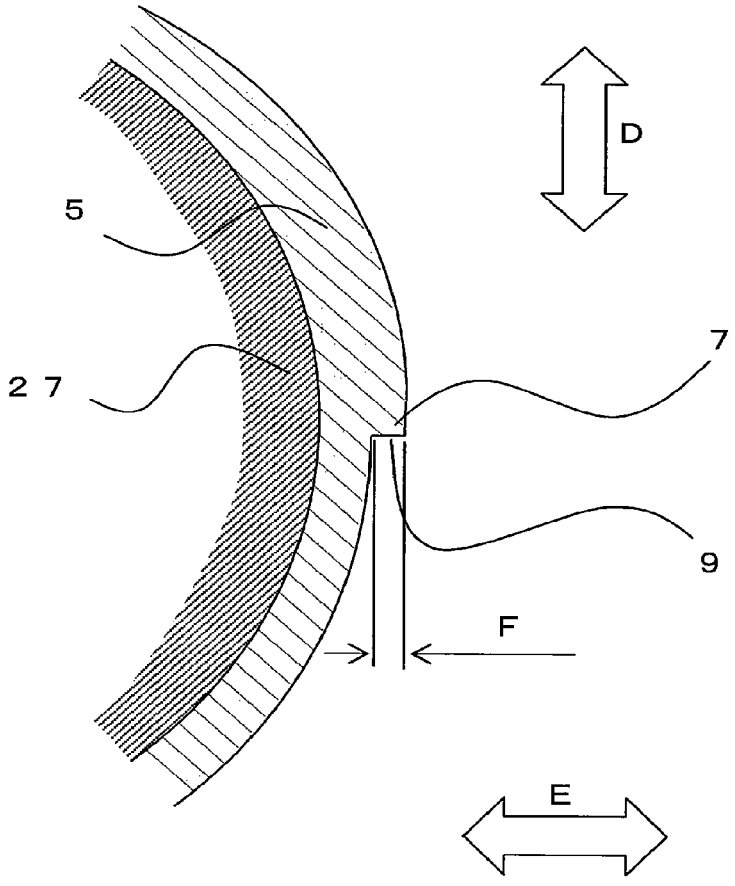
FIG. 7 is an enlarged view of a protruding portion 7 formed on the crimping portion 5.

FIG. 7 is an enlarged view of the proximity of the obtained protruding portion 7 of the crimping portion 5. An upper part of the protruding portion 7 (a contacting part with the mold 31*a*) is formed in a smooth curve. Whereas a level difference 9 according to the shape of the tip portion of the mold 31*b* is formed at a lower part of the protruding portion 7 (a contacting part with the mold 31*b*).

Here, the height of the protruding portion 7 (F in the drawing) is less than the thickness of the crimping portion 5 before crimping. If the height of the protruding portion 7 is greater with regard to the thickness of the crimping portion, a recess is likely to be formed on the inner surface of the crimping portion 5. That is, the amount of metal that flows outward (the protruding portion 7) increases, and, therefore, a recess according to the metal flow is likely to be formed on the inner surface side.

If such a recess is formed, the adhesive property with the covered area 27 may be impaired. For example, when left in a high temperature environment or the like, the compression force given to the covered area 27 may be released and a minute gap may be formed between the recess portion and the covered area 27. Such a gap can serve as a path for moisture entry, which causes a problem.

On the other hand, if the height of the protruding portion 7 is less than the thickness of the crimping portion 5 before crimping, the amount of metal that flows to the side of the protruding portion 7 diminishes when the crimping portion 5 is compressed during crimping and it is possible to suppress the formation of a recess portion on the inner surface of the crimping portion 5.

The height of the protruding portion 7 is a height from a base part of the level difference 9 (the border part between the protruding portion 7 and the arc portion) to a top part of the protruding portion 7 when viewed from the direction (a vertical direction in the drawing shown by an arrow E) that is perpendicular to the crimping direction (a vertical direction in the drawing shown by an arrow D) of the molds 31*a* and 31*b* on the cross section. Also, the thickness of the crimping portion 5 before crimping can be obtained from, for example, the terminal body 3.

Also, to decrease the height of the protruding portion 7, it is preferred to make the tip thickness of the end part of the mold 31*b* as thin as possible. That is, since the height of the protruding portion 7 is determined by the tip thickness of the end part of the mold 31*b* and the clearance of the molds 31*a* and 31*b*, the tip thickness of the mold 31*b* may be designed taking the rigidity of the mold 31*b* in consideration.

According to the present embodiment, since the height of the protruding portion 7 is less than the thickness of the crimping portion 5 before crimping, it is possible to suppress the formation of a recess on the inner surface of the crimping portion 5. Therefore, it is possible to keep the adhesive property between the covered area 27 and the inner surface of the crimping portion 5 and a watertight property of the crimping portion 5 can be secured.

The shape of the tip part of the mold 31*b* is not limited to the shape shown in FIG. 6 and the like. That is, the tip part of the mold 31*b* may be in forms other than the one shown in FIG. 6 in which the tip part of the mold 31 is formed only with a surface perpendicular to the crimping direction.

Figure 8:
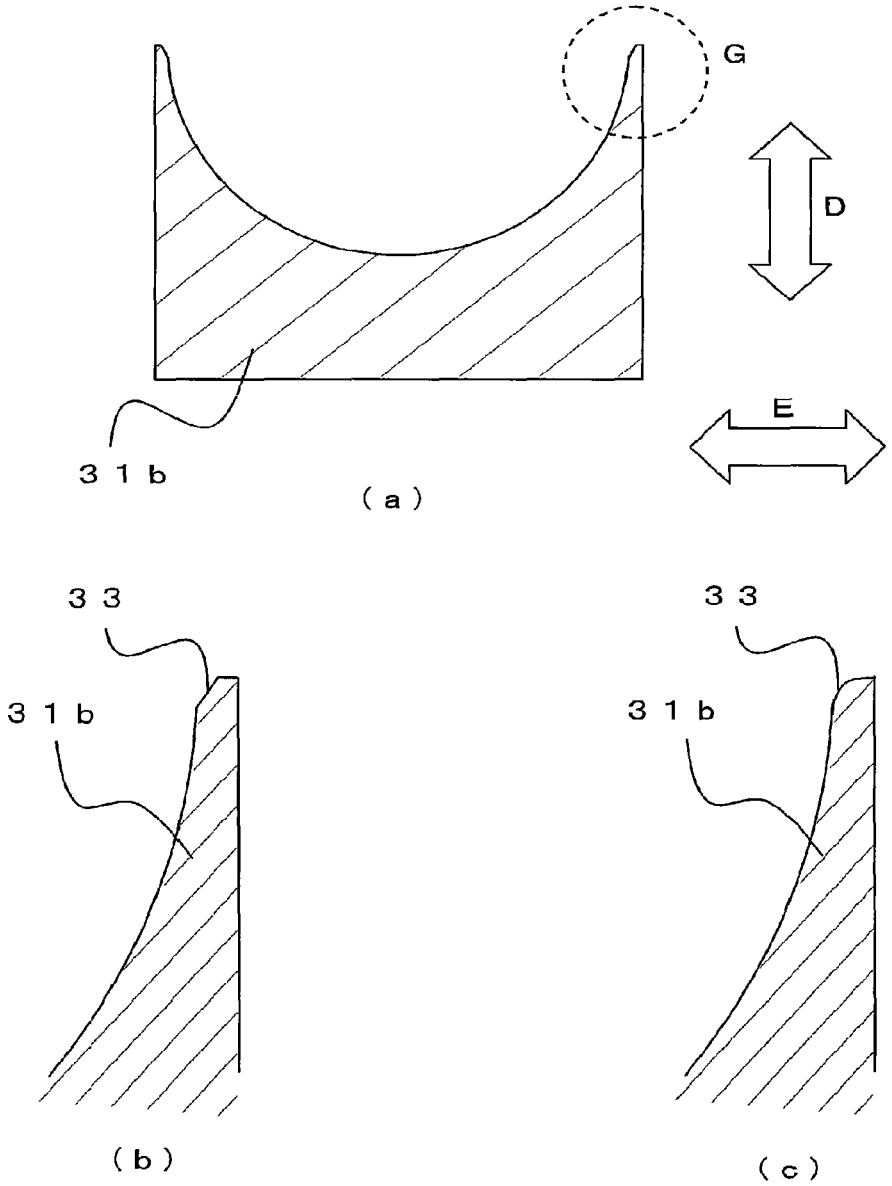
FIG. 8 (*a*) is an overall view showing another mold 31*b*.

For example, FIG. 8 (*a*) is an overall view showing another embodiment of the mold 31*b* and FIG. 8 (*b*) is an enlargement view of G part in FIG. 8 (*a*). As shown in FIG. 8 (*b*), a tapered portion 33, which tilts to the direction (an arrow E in the drawing) that is perpendicular to the crimping direction (an arrow D in the drawing) on the cross section, may be formed at the tip part of the mold 31*b*.

Also, this tapered portion 33 may be formed, not in a straight line as shown in FIG. 8 (*b*), but in an arc shape as shown in FIG. 8 (*c*). That is, the tip part of the mold 31*b* is not formed only with a surface that is perpendicular to the crimping direction, but the tapered portion 33 may be formed at the boundary part between the surface perpendicular to the crimping direction and the arc surface, smoothly connecting the same.

Figure 9:
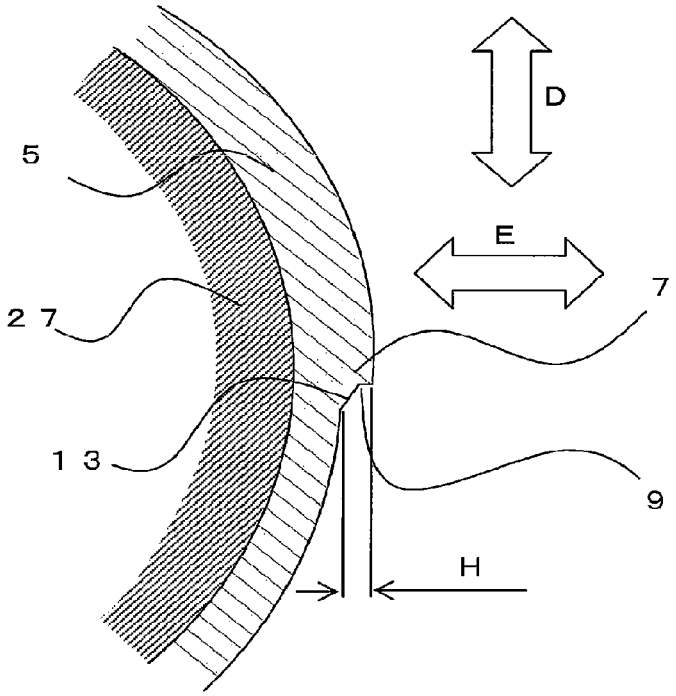
FIG. 9 (*a*) is an enlargement view of the protruding portion 7 formed on the crimping portion 5 by the mold shown in FIG. 8 (*b*).
Figure 9:
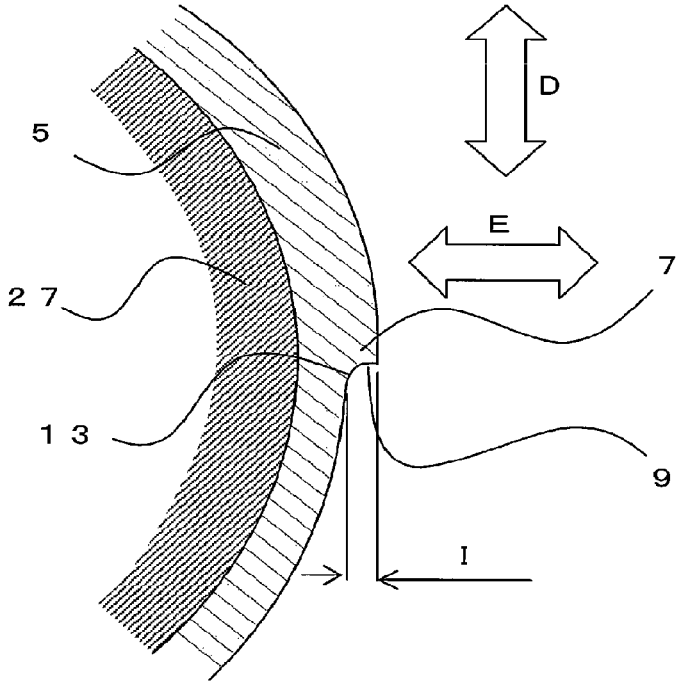

FIG. 9 (*a*) is a partial enlargement cross section of the proximity of the protruding portion 7 of the crimping portion 5 crimped by the mold shown in FIG. 8 (*b*). As shown in FIG. 9 (*a*), a tilted portion 13 that tilts linearly to the direction (an arrow E in the drawing) that is perpendicular to the crimping direction (an arrow D in the drawing) is formed at the level difference 9. The height of the protruding portion 7 (H in the drawing) is a height from a base part of the level difference 9 (the border part between the protruding portion 7 and the arc portion) to a top part of the protruding portion 7 when viewed from the direction (the direction of the arrow E) that is perpendicular to the crimping direction (the direction of the arrow D) of the molds 31*a* and 31*b* on the cross section.

Similarly, FIG. 9 (*b*) is a partial enlargement cross section of the proximity of the protruding portion 7 of the crimping portion 5 crimped by the mold shown in FIG. 8 (*c*). As shown in FIG. 9 (*b*), a tilted portion 13 that tilts in an arc shape to the direction (an arrow E in the drawing) that is perpendicular to the crimping direction (an arrow D in the drawing) is formed at the level difference 9. The height of the protruding portion 7 (I in the drawing) is also a height from the base part of the level difference 9 (the border part between the protruding portion 7 and the arc portion) to the top part of the protruding portion 7 when viewed from the direction (the direction of the arrow E) that is perpendicular to the crimping direction (the direction of the arrow D) of the molds 31*a* and 31*b* on the cross section.

WORKING EXAMPLES

Next, a wire harness according to the present invention and a wire harness for comparison are manufactured for experiments and the performance of each of the samples is tested. The tests will be described below.

Figure 10:
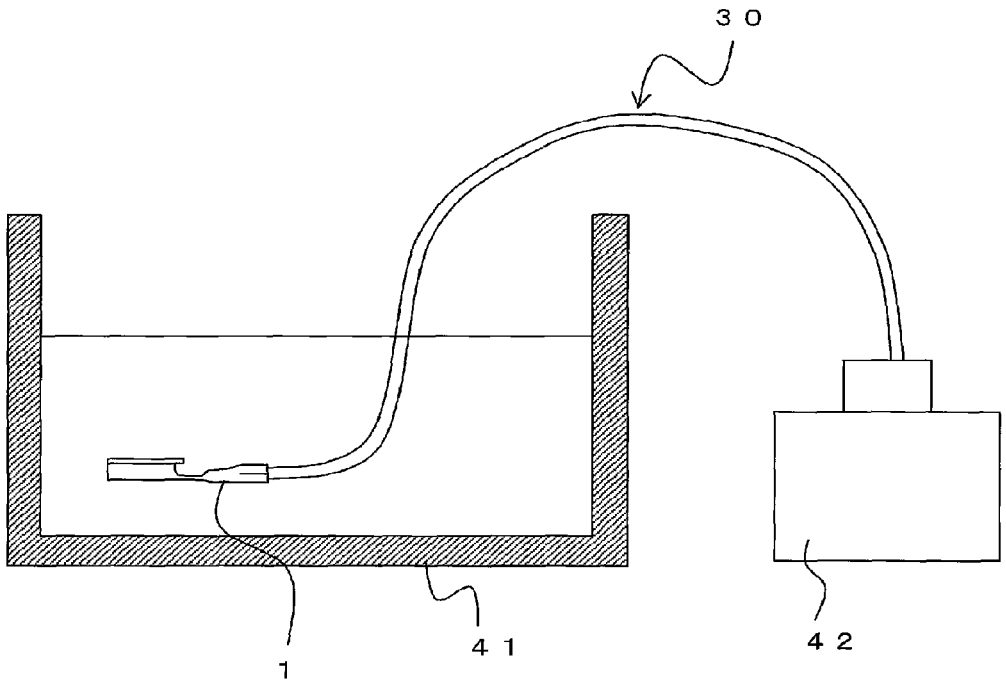
FIG. 10 shows a method for evaluating a water cut-off performance of the wire harness 30.

Air is supplied from the coated wire of the wire harness toward the terminal to test whether the air leaks out of the rear end part or not. FIG. 10 shows an outline of the method of the experiment. In the experiment, the terminal 1, which is crimped to the wire harness 30, is placed into a water tank 41 containing water and pressurized air is supplied from an end part of the wire harness 30 toward the terminal 1 by a regulator 42.

(Wire Harness)

For the base material of the terminal, a copper alloy material FAS-680 (made by Furukawa Electric Co., Ltd, Ni: 2.3 mass %, Si: 0.6 mass %, Sn: 0.15%, Zn: 0.5 mass %, Mg: 0.1 mass %, remainder: Cu and unavoidable impurities) having a thickness of 0.25 mm and a structure shown in FIG. 1 was used. For the electric wire, an aluminum alloy wire (wire diameter of 0.43 mm) was used. The composition of the core wire is Fe: 0.2 mass %, Cu: 0.2 mass %, Mg: 0.1 mass %, Si: 0.04 mass %, remainder: Al and unavoidable impurities. The diameter of the core wire is 2.1 mm, the outer diameter of the electric wire is 2.8 mm, and the length of the electric wire is 30 cm. Then, an end part of the electric wire, with exposed core wires, was inserted into the crimping portion of the crimping terminal to be crimped by the crimping device provided with the crimping mold shown in FIG. 5. The ratio of compression (the ratio of an area of cross section after crimping to an area of cross section before crimping) at this occasion was set to be 70%. In this way, a protruding portion (parting line) was formed at the part which is covered and crimped.

Working Examples 1, 2

On this occasion, the height of the protruding portion of Example 1 and 2, which was varied by changing the thickness of the tip of the mold, was 0.1 mm and 0.2 mm respectively.

Comparative Example 3

Comparative Example 3 is similar to Working Examples 1 and 2 except that the height of the protruding portion was set to be 0.3 mm by changing the thickness of the tip of the mold.

Working Examples 1, 2 and Comparative Example 3 were named as Sample 1-3 and number of samples of each of the Samples n was five. The pressure of a maximum of 400 kPa was applied thereto and the one with no leaks at 400 kPa was marked as a success. The results are shown in Table 1.

TABLE 1

| | Thickness before crimping | Protrusion height after crimping | Success Rate of the leak test |
|---|---|---|---|
| 1 | 0.25 mm | 0.1 mm | 100% |
| 2 | 0.25 mm | 0.2 mm | 100% |
| 3 | 0.25 mm | 0.3 mm | 80% |

As shown in Table 1, the success rates of No. 1 and No. 2 having the protruding heights less than the thickness of the terminal before crimping were 100%. However, leak was found in No. 3 having the protruding height greater than the thickness of the terminal before crimping and its success rate was 80%.

Also, although an electric wire having an outer diameter of 2.8 mm was used in the above working examples, it was similarly possible to suppress the formation of a recess portion on the inner surface of the crimping portion by making the protruding height less than the thickness of the terminal before crimping when electrical wires with different diameters were used. Particularly, if the protruding height was 2.0 mm or less, the success rate for the tests for water cut-off performance was 100%.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

For example, although the cases in which aluminum electric wires were used for Working Examples are described, it is not limited thereto and copper may be used for the electric wires.

Also, although two molds 31*a* and 31*b* are used to crimp and connect the terminal with the electric wire in the above embodiments, three or more molds may be used, for example. Similarly in such cases, the tip part of the mold requires a certain thickness since it is required to secure the certain rigidity. If such a mold is used, the protruding portion is formed along a longitudinal direction of the terminal and the protruded height of the protruding portion is preferably equal to or less than the thickness of the crimping portion before crimping.

Also, it is possible to bundle a plurality of the wire harness according to the present invention. In the present invention, such a structure in which a plurality of wire harness are bundled together is called a wire harness structure.

DESCRIPTION OF NOTATIONS

1 . . . terminal
3 . . . terminal body
5 . . . crimping portion
7 . . . protruding portion
9 . . . level difference
11 . . . sealed portion
13 . . . tilted portion
15 . . . elastic contacting piece
17 . . . front-end portion
19 . . . rear-end portion
21 . . . joint portion
23 . . . coated wire
25 . . . wire
27 . . . covered portion
30 . . . wire harness
31*a*, 31*b* . . . mold
33 . . . tapered portion
41 . . . water tank
42 . . . regulator

What is claimed is:

1. A wire harness comprising:

a coated wire and a terminal that are connected with each other, wherein the terminal includes an approximately cylindrical crimping portion, in which the coated wire is crimped, and a terminal body;

the crimping portion is formed of a plate-like material rolled up into a substantially cylindrical shape with edges of the plate-like material being welded together at a joining part;

except for a part through which the coated wire is inserted, other parts of the crimping portion are closed;

a protruding portion is formed along a longitudinal direction of the terminal on a periphery surface of the crimping portion that corresponds to a covered portion of the coated wire; and a protruding height of the protruding portion from a periphery surface of the crimping portion in a direction perpendicular to a compression direction of the crimping portion on a cross section in a diameter direction of the crimping portion is equal to or less than a body thickness of the crimping portion before crimping, wherein a level difference is formed between the protruding portion and the periphery surface of the crimping portion on the cross section in the diameter direction of the crimping portion;

a surface perpendicular to the compression direction at the protruding portion is formed to the periphery of the protruding portion;

a tilted portion or a smoothly connecting tilted portion is formed at a boundary part between the surface perpendicular to the compression direction of the crimping portion at a base part of the protruding portion and an arc surface of the periphery of the crimping portion; and the joining part and the protruding portion are formed at different positions in a circumferential direction on a periphery surface of the crimping portion.

2. The wire harness according to claim 1, wherein:

the protruding portion is formed at a position that corresponds to a fitting section of a first mold and a second mold that are used for crimping.

3. A method of connecting a terminal and a coated wire wherein:

the terminal includes a crimping portion, in which the coated wire is crimped, and a terminal body;

the crimping portion is formed by rolling up a plate-like material into an approximately cylindrical shape, and joining and welding edges of the plate-like material at a joining part; and except for a part through which the coated wire is inserted, other parts of the crimping portion are closed, the method comprising:

inserting the coated wire into the crimping portion;

using a first mold and a second mold that face each other to press the crimping portion;

fitting the first mold into an inner part of the second mold;

crimping a covered portion of the coated wire at the crimping portion; and forming a protruding portion on the periphery surface of the crimping portion at a position corresponding to a fitting section of the first mold and the second mold, wherein a protruding height of the protruding portion from a periphery surface of the crimping portion in a direction perpendicular to a compression direction of the crimping portion on a cross section in a diameter direction of the crimping portion is equal to or less than a body thickness of the crimping portion before crimping;

a tapered portion or a smoothly connecting tapered portion that is tilted inward to a direction perpendicular to the compression direction of the first mold and the second mold is provided at an end portion of the first mold;

on the cross section in the diameter direction of the crimping portion, a level difference corresponding to the shape of the end portion of the first mold is formed on the protruding portion between the protruding portion and the periphery surface of the crimping portion;

a surface perpendicular to the compression direction at the protruding portion is formed to the periphery of the protruding portion;

a tilted portion or a smoothly connecting tilted portion is formed at a boundary part between the surface perpendicular to the compression direction of the crimping portion at a base part of the protruding portion and an arc surface of the periphery of the crimping portion; and the joining part and the protruding portion are formed at different positions in a circumferential direction on a periphery surface of the crimping portion.

4. A mold used for crimping a terminal and a coated wire comprising a first mold and a second mold that face each other, wherein:

the first mold fits into an inner portion of the second mold so that it is possible to crimp a covered portion of the coated wire with the terminal;

a tapered portion or a smoothly connecting tapered portion that is tilted inward to a direction perpendicular to a compression direction of the first mold and the second mold is provided at an end portion of the first mold;

a protruding portion according to a shape of the end part of the first mold is formed along a longitudinal direction of the terminal on a periphery surface of a crimping portion of the terminal that corresponds to a covered portion of the coated wire;

a level difference is formed between the protruding portion and the periphery surface of the crimping portion on the cross section in the diameter direction of the crimping portion;

a surface perpendicular to the compression direction at the protruding portion is formed to the periphery of the protruding portion; and a tilted portion or a smoothly connecting tilted portion is formed at a boundary part between the surface perpendicular to the compression direction of the crimping portion at a base part of the protruding portion and an arc surface of the periphery of the crimping portion, wherein the level difference and a joining part of the terminal are formed at different positions in a circumferential direction on a periphery surface of the terminal.

* * * * *